United States Patent [19]

Hannover et al.

[11] 4,000,700

[45] Jan. 4, 1977

[54] RAILWAY VEHICLE AND SWITCHING MECHANISM THEREFOR

[75] Inventors: Hans-Otto Hannover, Herdecke; Johannes Gerhard Spöler, Hagen, both of Germany

[73] Assignee: Demag Aktiengesellschaft, Duisburg, Germany

[22] Filed: Mar. 6, 1975

[21] Appl. No.: 556,004

[30] Foreign Application Priority Data

Mar. 12, 1974 Germany ..... 2411686

[52] U.S. Cl. ..... 104/130; 104/247

[51] Int. Cl.[2] ..... E01B 25/12

[58] Field of Search ..... 104/130, 105, 245, 247, 104/88, 89, 91, 96, 118, 120; 105/141, 148, 215 R; 246/427

[56] References Cited

UNITED STATES PATENTS

| | | | |
|---|---|---|---|
| 3,113,529 | 12/1963 | Maestrelli | 104/247 |
| 3,225,704 | 12/1965 | Gilvar et al. | 104/130 X |
| 3,799,062 | 3/1974 | Stöcker | 104/105 |
| 3,811,383 | 5/1974 | Butzow | 246/427 X |
| 3,828,691 | 8/1974 | Purath | 104/130 X |

*Primary Examiner*—Robert J. Spar
*Assistant Examiner*—Randolph A. Reese
*Attorney, Agent, or Firm*—Mandeville and Schweitzer

[57] ABSTRACT

A rail guidance system is provided for railway vehicles using a combination of rimless support wheels running on horizontal surfaces, and guided by special opposed guide wheels and direction control wheels running on vertical surfaces on each side thereof in which the main vehicle guiding surfaces recede from their regular vertical plane in those areas where branch lines interconnect in the guidance system to avoid jamming of the guide wheels between the opposed main guiding surfaces and the auxiliary guide surfaces provided at such branch connections. The system includes additional cam control surfaces for camming the direction control wheels into engagement with auxiliary guide surfaces at the branch connections. The wheels of the invention, in addition, are comprised of lightweight materials such as aluminum, for example, or resins to reduce the degree of inertia involved when the wheels change direction of rotation from one guiding surface to another. The bearing surfaces of the wheels may be resilient to reduce impact noise and to absorb jolts from such impacts.

5 Claims, 2 Drawing Figures

RAILWAY VEHICLE AND SWITCHING MECHANISM THEREFOR

BACKGROUND AND DESCRIPTION OF THE INVENTION

Railway systems of the type presently gaining favor in large metropolitan areas in which railway cars travel in close succession typically do not have switches in which rail sections are moved, as in conventional railroads. Rather than using switches at branch intersections, the direction of traverse at the branch is established by the placement of auxiliary direction control rails and control wheels on the vehicle which follow the auxiliary direction control rails. Rail systems of this type, including monorail systems, utilize two sets of wheels including traction support wheels rotating on horizontal axes and a separate set of guide wheels disposed on vertical axes. With this type of installation, the surfaces upon which the wheels travel are part of the support system and are called "girder road systems" having either bottom-supported or suspended railway vehicles. The supporting girders must have large dimensions in order to guarantee the required rigidity as well as the safe guidance of the vehicles. One such prior art development is disclosed in German Patent Publication DT-OS 2,034,106. However, with this system, wheels with flanges are utilized to guide the vehicles along the main course with laterally displaceable auxiliary wheels to guide the vehicles when traversing a branch intersection. However, because of the need for rigid impact surfaces in order to utilize the flanges, such arrangements are not entirely satisfactory for use in cities due to the resulting noise.

A further monorail system development is disclosed in U.S. Pat. No. 3,799,062 which teaches a double U-shaped girder or monorail for the vehicles equipped with support wheels without flanges. Moreover, that patent teaches the use of guide wheels and separate direction control wheels engaging vertical surfaces. However, with this particular arrangement the opposed guide surfaces are spaced so far apart from each other that there is difficulty in aligning the two opposed guiding surfaces, particularly in those areas where the guiding surfaces are curved adjacent a branch intersection. If the two spaced opposed guiding surfaces are not completely and accurately aligned, there is the possibility that the wheels will become jammed at such intersections or at least that they will be subject to a high degree of wear. Thus, it has been found desirable to utilize a single guide surface on one side of the vehicle path in branch connection or intersection areas so as to eliminate the need for the precise alignment of opposed guiding surfaces in those areas. This, in turn, eliminates opposed forces generated by the use of two such opposed guiding surfaces in the branch intersection areas.

With this invention, a rail installation of the girder road or monorail type is provided which utilizes single auxiliary branch guide surfaces or conductor rails on one side of the vehicle path in the branch intersection areas, so that the vehicles are guided precisely and eliminates the cost involved in having to precisely align opposed guiding surfaces on each side of the vehicle path in those areas. This is achieved by providing the regular guide surfaces on the side of the vehicle opposite to the auxiliary branch guide surface being utilized at any one branch intersection with a recessed area so that the opposed regular guide wheels in those areas where the direction control wheels are guiding the vehicle, do not come in contact with any guide surface on the opposite side of the vehicle. Thus, no opposing forces are generated on either side of the vehicle to cause jamming between the opposed regular guide wheels or unnecessary wear of the impact surfaces thereof.

The conductor or auxiliary branch guide rails are tapered at the entry and exit ends thereof. Thus, at the moment the guide wheels come in contact with the tapered entry end of the auxiliary branch guide rail they are put into a rotary motion. Also at this moment, the direction control wheels, arranged at the same side of the vehicle, reach the auxiliary branch guide rail surface tapered inward as well so that the vehicle is only guided on one side of the vehicle through the interaction between the direction control wheel and the single auxiliary guide rail on that side of the vehicle. Because of the recessed area on the opposite side of the vehicle along the regular guide surface, the guide wheels and the direction control wheels on that opposite side of the vehicle are not in touch with any surface. This eliminates any opposed or double guidance which might generate opposed forces causing jamming of the wheels between two such opposed guiding surfaces. The regular guide surface gradually recedes or tapers into its recessed area the exact amount of the taper of the auxiliary branch guide rails on the opposite side of the vehicle course.

A further feature of the invention is that a lightweight material such as aluminum or a resin is used for the wheel body of the regular guide wheels and the direction control wheels of the invention here. this is particularly helpful because the guide wheels reverse rotation from the regular guide surface to the auxiliary direction control surface and the reduced weight reduces the degree of inertia involved in the changing of direction of rotation. This reduces jolts or a feeling of impact on the vehicle itself during this change of direction. Moreover, preferably, in accordance herewith, the direction control wheels are of a lesser diameter than the associated guide wheels therewith. Thus, when the vehicle is travelling along a regular course of the system when the direction control wheels are swung into the path of their associated guide wheels, the direction control wheels do not touch the guide surfaces. Also, in order to compensate for track clearance and manufacturing tolerances, the distance between the recessed area of the regular guide surface and the opposed auxiliary branch guide rail surface at the initial area of branch intersection is within the range of between about two and ten millimeters greater than the diameter of the guide wheels. Preferably, the support wheels, as well as the guide wheels will have resilient bearing surfaces in order to reduce noise and absorb impacts between the wheel surfaces and the guide surfaces therefor.

Also in accordance with this invention, and as discussed in more detail below, the direction control wheels pivot around the vertical axis of their associated guide wheels so that they are located in the guide wheel path when not in use, as discussed above, and when they are in use they pivot laterally to a position adjacent the guide wheel path. The distance between the guide wheels and their associated direction control wheels equals the distance between the opposed guiding surfaces of each individual branch conductor or auxiliary guide rail.

For the safe guidance of the vehicles, in accordance herewith, the direction control wheels are arranged adjacent the four corners of the vehicles involved in the installation and all are connected by a linkage which provides simultaneous shifting, which linkage is equipped with a jamming guard which shifts the direction control wheel immediately before the vehicle enters a branch intersection so as to direct the proper traverse of the vehicle through the intersection. The jamming guard may be in the form of a cam which engages a cam guiding surface for the proper switch direction of the vehicle for its traverse. For further details concerning this linkage arrangement and its method of operation, reference is made to the teachings of U.S. Pat. No. 3,828,691, which is hereby incorporated by reference.

For a more complete understanding of the present invention and a better appreciation of its intended advantages, reference should be made to the following description of one embodiment of the new and improved railway apparatus taken in conjunction with the accompanying drawings illustrating the invention.

DETAILED DESCRIPTION OF THE PRESENT INVENTION

Figure 1:
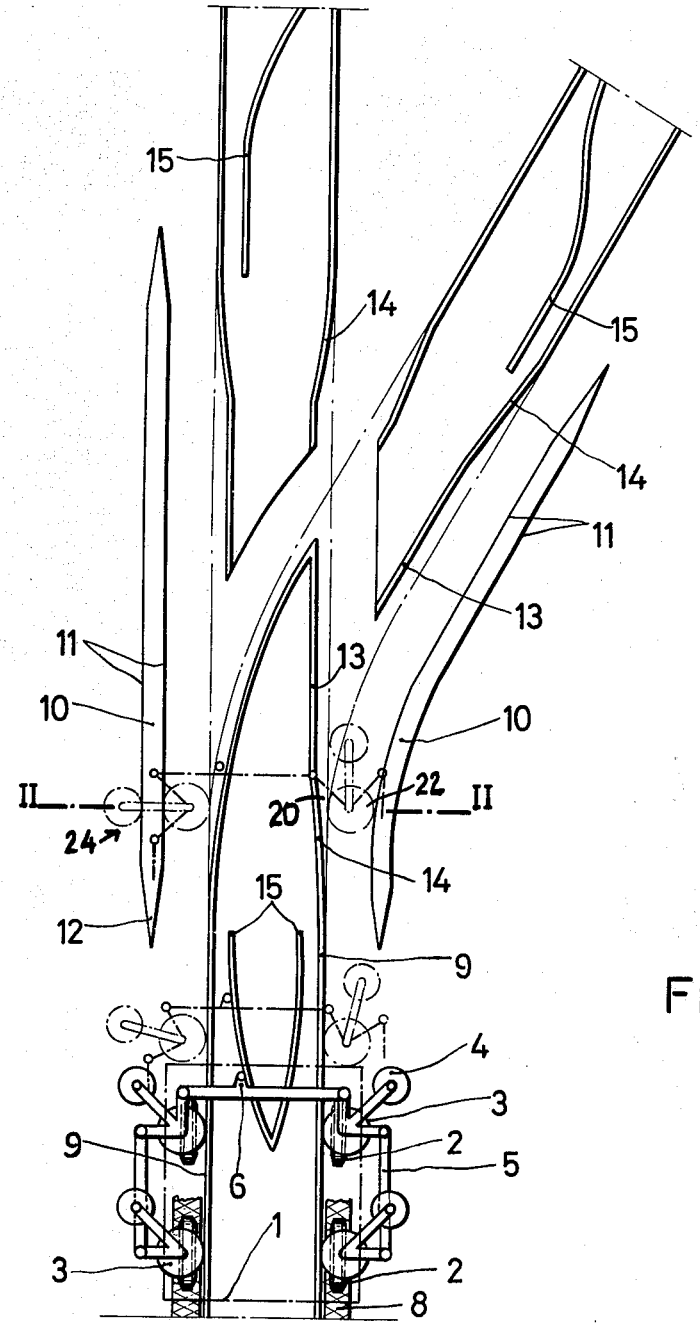
FIG. 1 is a schematic plan view of a railway system embodying the principles of the present invention.
Figure 2:
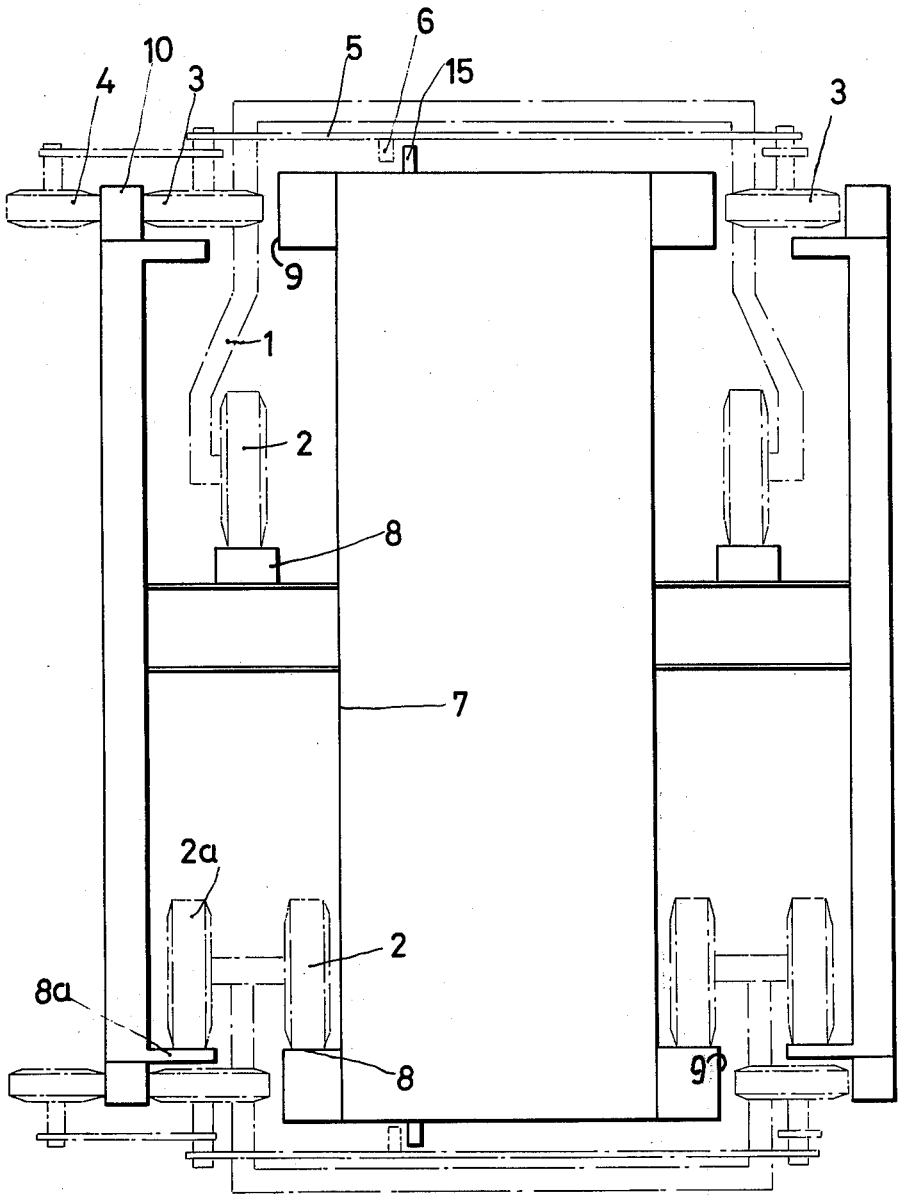
FIG. 2 is a cross sectional view taken along lines II—II of FIG. 1.

Referring to the drawings in which like reference characters refer to like parts throughout the several views thereof a vertical support system or girder 7 is shown for traverse by vehicles such as 1 shown in phantom lines in FIG. 1. Each vehicle 1 is equipped at all four corners with support wheels 2 which run on rails 8, as shown in FIG. 2. In this connection, the invention may be utilized with a single system or a multi-level system. In the illustrated embodiment, a multi-level system is shown. Thus, suspended vehicles 1 are equipped with auxiliary wheels 2*a* (FIG. 2) adjacent regular wheels 2. Such auxiliary wheels 2*a* are supported on auxiliary rails 8*a* at branch intersections. As can be seen in FIG. 2, auxiliary rails 8*a* are disposed on the conductor or auxiliary branch guide rails 10.

Direction control wheels 4 are interconnected by a linkage 5 to pivot around the axis of their associated guide wheels 3. Linkage 5 is equipped with a jamming guard 6 or cam which engages a cam surface 15 so as to insure, before the vehicle enters a branch intersection, that the direction control wheels 4 are in a proper position for engaging the auxiliary branch guide surfaces 11 of the guide rail 10 when the vehicle enters an intersection. When a vehicle 1 is travelling along a regular track area of the system, the guide wheels 3 thereof rotate about vertical axes and engage vertical guide surfaces 9 on the support structure or girder 7. At the branch intersections, the vertical guide surfaces 9 gradually recede as at 14 into recessed areas or surfaces 13, Preferably, the receding tapered surfaces 14 are about one meter in length. The recessed areas 13 are recessed about five millimeters from the vertical plane of the regular vertical guide surfaces 9.

Adjacent the tapered surfaces 14, the auxiliary branch guide rails 10 are disposed with tapered inlet surfaces 12. The opposed guiding surfaces 11 of the conductor or auxiliary branch guide rails 10 are equally spaced in all areas therealong including curved areas so that the guide wheels 3 and their associated direction control wheels 4 can lead the vehicle across the branch intersection lines properly and depending upon the position of the direction control wheels 4. As stated above, the diameter of the direction control wheels 4 is smaller than that of the guide wheels 3 so that the direction control wheels 4 do not inadvertently touch the regular guide surfaces 9 or the auxiliary guide surfaces 11 facing the regular guide surfaces 9 in those areas where the two surfaces are opposed. Preferably, this difference in diameter between direction control wheels 4 and guide wheels 3 is about thirty millimeters.

Thus, in operation, cam 6 will engage cam surface 15 on one side or the other thereof depending upon which direction vehicle 1 is to traverse at a branch intersection. Cam 6 disposed on linkage 5 will through linkage 5 cause direction control wheels 4 either on one side of the vehicle or the other to pivot from a position in the path of the guide wheels 3 to a position laterally of their associated guide wheels 3 (to the left as shown in FIG. 1). As the vehicle progresses further into the intersection, the left-hand direction control wheels 4 and guide wheels 3 will engage the opposed surfaces 11 of the auxiliary branch control rail 10 on either side thereof to guide vehicle 1 to the left in the intersection shown. In the illustration of FIG. 1, that position is shown at 24. Because of the tapering 14 of the regular guide surface 9 on the opposite side of the vehicle 1, the opposed guide wheel 3 on the opposite side of the vehicle shown in position 22 will be spaced the distance 20 from the tapered surface 14 and the following recessed area 13. Thus, only the guide wheels and the direction control wheels on one side of the vehicle are engaged during the switching procedure at the branch intersection eliminating the need for the precise alignment of opposed guiding surfaces on each side of such vehicles at such branch intersections. This elimination of opposed guiding surfaces reduces the possibility of jamming of the guide wheels at such intersections and also reduces the wear on the impact surfaces of the various wheels.

It should be understood that the railway apparatus herein illustrated and described is intended to be representative only, as certain changes may be made therein without departing from the teachings of the disclosure. For example, other arrangements could be utilized for causing the shifting of the linkage 5 in one direction or the other for determining the direction of the vehicle at any one branch intersection. Accordingly, reference should be made to the following appended claims in determining the full scope of the invention.

I claim:

1. In a railway system comprising a support for said system, said support including horizontal main rail surfaces, first vertical main guide rail surfaces and second vertical surfaces being on an auxiliary rail disposed adjacent branch intersections of said system; at least one vehicle mounting traction wheels on opposite sides thereof adjacent each corner for rotation about horizontal axes and mounting guide wheels on opposite sides thereof adjacent each corner for rotation about vertical axes; said traction wheels being adapted to engage said horizontal main rail surfaces for propulsion of said vehicle therealong, and said guide wheels being adapted to engage said first vertical main guide rail surfaces for guiding said vehicle; a control wheel pivoted on the axis of each of said guide wheels and mounted for rotation about a vertical axis, each of said control wheels being adapted to engage said second vertical auxiliary directional rail in said branch intersections of said system; and lever means interconnecting each of said control wheels with one of said guide wheels, said lever means being adapted selectively to pivot each of said control wheels about the axis of one of said guide wheels for selective engagement with said second vertical auxiliary directional rail; the improvement comrising a. said second vertical auxiliary directional rail having a vertical auxiliary directonal engaging surface on each side thereof, b. each guide wheel and its associated control wheel on one side of said vehicle engages one side of said auxiliary vertical directional rail in opposed relation in said branch intersections of said system and c. said first vertical main rail guide surfaces being recessed on the side of said support opposite said opposed second vertical surfaces whereby said guide wheels on that side are spaced from said first vertical surfaces in said branch intersections.

2. The apparatus of claim 1, further characterized in that a. the spacing between each guide wheel and its associated control wheel equals the spacing between the said vertical surfaces on opposite sides of said second vertical auxiliary control rail.

3. The apparatus of claim 1, further characterized in that a. the wheel bodies of each of said guide wheels and said directional control wheels are comprised of a lightweight material.

4. The apparatus of claim 1, further characterized in that a. the distance between said recessed first vertical surfaces and the opposed said second vertical surfaces at branch intersections is within the range of between about two and ten millimeters greater than the diameter of said guide wheels.

5. The apparatus of claim 1, further characterized by a. cam follower means connected to said lever means, and b. cam rail means on said support for moving said cam follower means and said lever means for said selective engagement of said control wheels with said second vertical auxiliary directonal rail.

* * * * *